United States Patent [19]

Miglia

[11] Patent Number: 4,792,805

[45] Date of Patent: Dec. 20, 1988

[54] MULTIFUNCTION ACTIVE ARRAY

[75] Inventor: Egidio Miglia, Woodland Hills, Calif.

[73] Assignee: Hughes Aircraft Company, Los Angeles, Calif.

[21] Appl. No.: 43,406

[22] Filed: Apr. 28, 1987

[51] Int. Cl.[4] ..... H01Q 3/22

[52] U.S. Cl. ..... 342/372; 342/154; 342/157; 342/158

[58] Field of Search ..... 342/368–377, 342/383–389, 149–158

[56] References Cited

U.S. PATENT DOCUMENTS

| | | | |
|---|---|---|---|
| 3,202,992 | 8/1965 | Kent et al. | 343/100 |
| 3,345,631 | 10/1967 | Chamberlin, Jr. | 342/372 |
| 3,403,401 | 9/1968 | Cragon et al. | 342/373 |
| 3,652,978 | 3/1972 | Halliday et al. | 340/3 R |
| 3,729,742 | 4/1973 | Boyns | 342/374 |
| 3,938,160 | 2/1976 | Mailloux et al. | 342/373 X |
| 3,940,770 | 2/1976 | Fassett et al. | 343/754 |
| 3,943,523 | 3/1976 | Fassett | 342/368 |
| 3,953,857 | 4/1976 | Jenks | 343/705 |
| 3,965,475 | 6/1976 | Deerkoski et al. | 342/374 |
| 4,607,259 | 8/1986 | Dragone | 343/758 |

*Primary Examiner*—Theodore M. Blum
*Assistant Examiner*—Bernarr Earl Gregory
*Attorney, Agent, or Firm*—Leonard A. Alkov; A. W. Karambelas

[57] ABSTRACT

A multifunction active array system is disclosed, wherein the array aperture may be partitioned into a plurality of arbitrary subapertures. The array system includes N radiative elements, each coupled to a corresponding active module. Each module is in turn connected to an aperture partition selector, which includes an M-way power divider/combiner device, having a module port and M device ports. Each device port is coupled through an RF switch to a partition port of the device. M N-way manifolds are provided, having N manifold ports coupled to a respective one of said partition ports of each selector. The manifolds are coupled to a receiver and an excitation source. Each partition may be formed by the desired connection of a particular module to a manifold by the respective positions of the RF switches. The array system provides the capabilities of partitioning the array into M or less subapertures to simultaneously generate sum patterns, difference patterns, guard patterns, and adaptive nullings. The partitions on receive and transmit are independent, and they may differ in any arbitrary manner. The subapertures may overlap.

20 Claims, 3 Drawing Sheets

MULTIFUNCTION ACTIVE ARRAY

BACKGROUND OF THE INVENTION

The invention relates to techniques for electronically varying the partitioning of planar arrays or phase scanned arrays into sub-arrays or subapertures.

In many airborne radar modes, in particular the terrain following and terrain avoidance modes, difference patterns stabilized with respect to the horizon are required. The technique generally used to generate sum and difference patterns in gimballed planar arrays or phased scanned arrays is to partition the array into quadrants with a separate output for each quadrant. The appropriate quadrant outputs are summed or differenced to provide a sum pattern and two difference patterns. The two difference patterns provide tracking error signals referenced to the antenna.

Conventional solutions to the problem of providing roll stabilized sum and difference patterns in airborne radars include providing a third gimbal or implementing rather cumbersome and not entirely satisfactory signal processing to derive roll stabilized tracking outputs. The roll gimbal technique is probably not feasible for active array systems of sufficient size to require liquid cooling. An alternative to the signal processing approach is needed.

It would therefore represent an advance in the art to provide an active array which can be electronically roll stabilized without the need for mechanical roll gimbals or cumbersome signal processing.

It would further be advantageous to provide a multifunction active array which may be electronically configured into a plurality of arbitrary sub-arrays or subapertures.

SUMMARY OF THE INVENTION

A multifunction active array system is disclosed, wherein the system aperture may be programmably subdivided into a plurality of subapertures. The array system comprises N radiative elements connected to N active modules. Each module is universal in the sense that each comprises the same elements.

Each module is in turn connected to an aperture partitioning selector, which includes an M-way power divider/combiner device. This device functions, in the receive mode, to divide the module receive signal into M components. In the transmit mode, the device functions to combine up to M excitation signal sources and couple the combined excitation signals to the module for amplification and radiation by the radiative element.

Each aperture partitioning selector further comprises M RF switches for coupling the respective ports of the M-way power divider/combiner device either to an "off" position or to an "on" position at a partition port.

The system further comprises M manifold apparatus having N selector ports, the corresponding partition ports of each aperture partitioning selector being connected to the N selector ports. Each manifold comprises an N-way power combiner/divider device, so that in the receive mode, the signals at each of the corresponding partition ports are summed. Thus, the selector provides the capability of selection of those radiative elements and modules whose receive signal contributions are combined in a particular one of the M subapertures. In the transmit sense, the manifold apparatus and partitioning selectors provide the capability of dividing M or less excitation signals into N components and providing a component to the selected ones of the modules for amplification and subsequent radiation.

The active array system may be configured to achieve one or more functions without making hardware changes. The array aperture can be partitioned into M or fewer subapertures. The subapertures can overlap and the aperture partitioning in the receive and transmit modes can differ in any arbitrary manner. Each subaperture can transmit and receive at different frequencies and scan angles. The system can provide sum, differences and guard patterns, adaptive nulling, off-broadside expanded bandwidth for large size apertures, and roll stabilization for all modes.

BRIEF DESCRIPTION OF THE DRAWINGS

These and other features and advantages of the present invention will become more apparent from the following detailed description of an exemplary embodiment thereof, as illustrated in the accompanying drawings, in which:

FIGS. 5A and 5B are functional diagrams illustrative of an array system as in FIG. 1 with a circular aperture, showing two possible overlapped aperture partitions.

DETAILED DESCRIPTION OF THE DISCLOSURE

Figure 1:
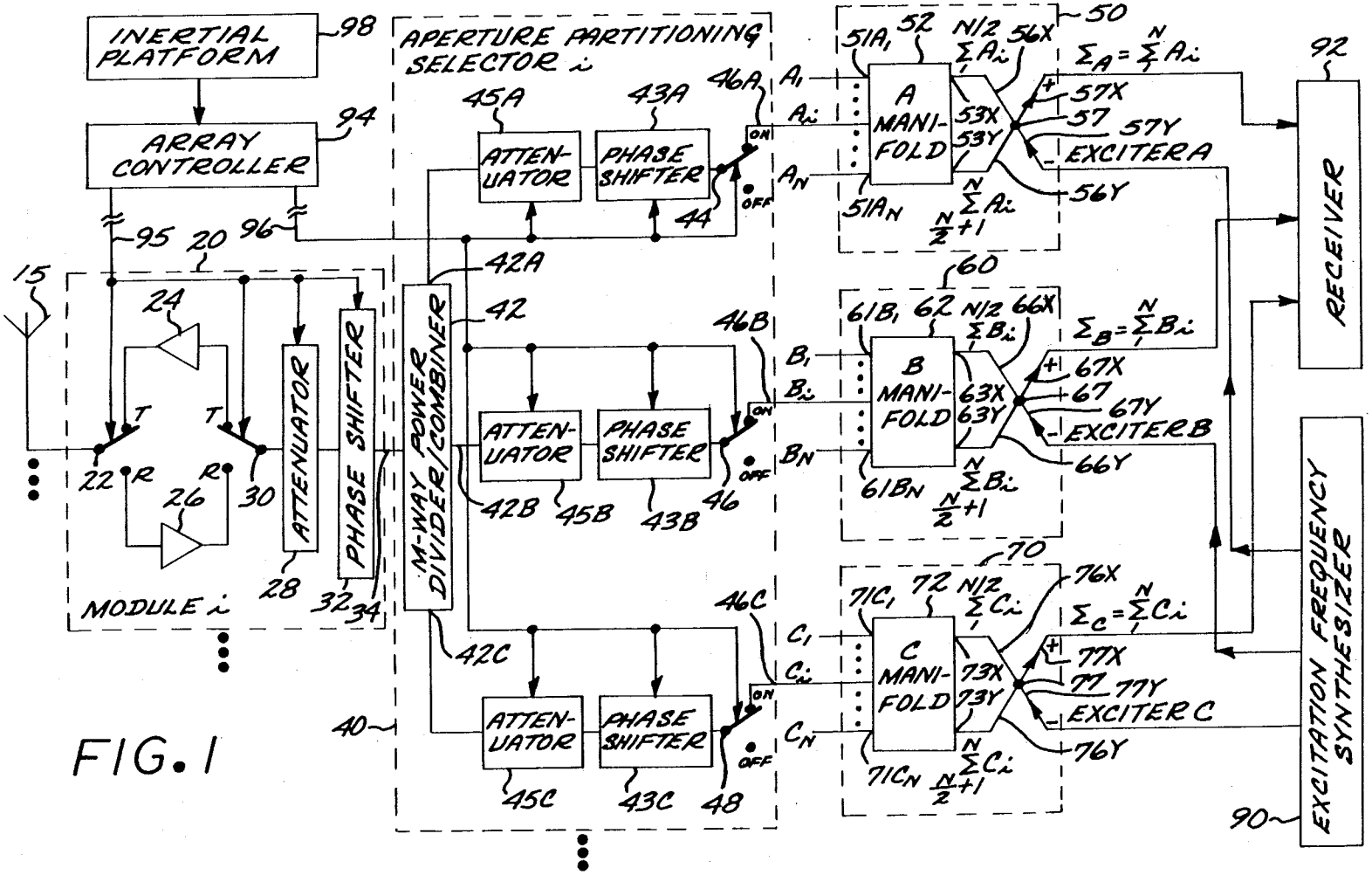
FIG. 1 is a simplified functional block diagram, for M=3, of a multifunction active array system embodying the invention.

Referring now to FIG. 1, a block diagram of a multifunction active array system embodying the invention is disclosed. As will be understood by those skilled in the art, the array comprises a plurality of radiative elements 15, each coupled to a corresponding active module 20. For clarity, only the "i"th element 15 and module 20 are shown in FIG. 1, where i is an index varying from 1 to N, and N represents the total number of modules. Each of the modules comprising the array is identical to the universal module 20 of FIG. 1.

Module 20 comprises a beam steering phase shifter 32 and a variable RF attenuator 28. These two devices may be connected either to the transmit channel comprising transmit amplifier 24 or to the receive channel comprising low noise amplifier 26 by RF switch 30. RF switch 22 connects either the receive channel or the transmit channel to the radiative element 15. The RF switches 22 and 30 are controlled by the array controller 94 to select either the module transmit channel when an excitation signal is provided to the module 20 or the module receive channel when the module 20 is selected to provide an amplified version of signals incident on the radiative element 15. In operation, the RF switches 22 and 30 are both either in the transmit "T" position or in the receive "R" position. The functions of these switches could alternatively be accomplished by RF circulator devices, well known to those skilled in the art.

The beam steering phase shifter 32 preferably is digitally controlled by controller 94, and introduces the phase shift necessary to steer the aperture beam in the desired direction, as is well known to those skilled in the art.

The variable attenuator 28 is also controlled by the array controller 94, and is used to weight the aperture to reduce the aperture sidelobe levels. The attenuator 28 can also be used for power management.

The array system further comprises N aperture partitioning selectors 40, each coupled to selector port 34 of a corresponding module 20. Each selector 40 comprises an M-way power divider/combiner device 42 having M device ports, respectively coupled through a programmable phase shifter and variable attenuator to a corresponding one of the M RF switches. For the embodiment shown in FIG. 1, the index M is chosen as three, so that each partitioning selector 40 comprises a three-way power divider/combiner 42 with three device ports 42A, 42B, 42C, three attenuators 45A, 45B, 45C, three phase shifters 43A, 43B, 43C, and three RF switches 44, 46, 48, all independently controllable by the array controller 94.

The array controller 94 preferably comprises a digital computer which is interfaced to the various elements it controls, such as the various RF switches, the variable attenuators and the beam steering phase shifters.

Each of the RF switches 44, 46 and 48 provides the capability of switching between an "off" position and an "on" position. When in the "off" position, each of the RF switches 44, 46 and 48 provides a matched load (not shown in FIG. 1) to both the "on" and the "off" ports of the corresponding RF switch. The RF switches 44, 46 and 48, therefore, provide a means for selectively connecting the respective device ports 42A, 42B, 42C to a corresponding partition port 46A, 46B, 46C of the selector 40. Each partition port 46A, 46B, 46C is connected to a corresponding one of the N selector ports $51A_i$, $61B_i$ and $71C_i$ of the M manifold apparatus, in this embodiment the A, B or C manifold apparatus 50, 60 or 70.

The output of each of the three RF switches 44, 46 48 at the respective partition port 46A, 46B, 46C is summed at the corresponding manifold apparatus 50, 60 or 70 with the outputs from the corresponding RF switch of each of the other aperture partitioning selectors 40 comprising the array system. Thus, as shown in FIG. 1, the respective outputs $A_i$ from the RF switches 44 are summed at the "A" manifold apparatus 50, the respective outputs $B_i$ are summed at the "B" manifold apparatus 60, and the outputs $C_i$ from the RF switches 48 are summed at the "C" manifold apparatus 70. If the index M were greater than three, e.g., 5, then the selector 40 would include two additional attenuators, phase shifters, and RF switches, the divider/combiner 42 would be a five-way device, and there would be two additional manifold apparatus (not shown), the "D" manifold apparatus and the "E" manifold apparatus.

In the embodiment of FIG. 1, each of the manifold apparatus 50, 60 and 70 comprises an N selector port by two network port manifold network 52, 62, 72, and a magic T coupler 57, 67, 77. The N selector ports of the respective manifold networks 52, 62, 72 are connected to the respective RF switch 44, 46 or 48 of each partitioning selector 40, and the two network ports are connected to the sidearm ports of the respective magic T coupler 57, 67 or 77.

Each of the manifold networks 52, 62 and 72 are typically constructed of two uniform corporate networks such as are well known to those skilled in the art, acting as uniformly weighted power combiner/divider circuits. In the receive mode, the manifold networks 52, 62, 72 are constructed to separately sum the signals at the first N/2 selector ports and the signals at the latter N/2 selector ports, and to provide the respective partial sums at the respective X and Y network ports to be coupled to the respective sidearm ports of the respective Magic T coupler 57, 67 or 77. For example, manifold network 52 is adapted to sum the selector signals $A_i$, $i=1$ to $N/2$, and to provide the resulting partial sum at port 53X, and to sum the signal $A_i$, $i=N/2+1$ to N, to provide the resulting and partial sum at port 53Y. In the transmit mode, the excitation signals applied at the respective X and Y ports of the manifold networks 52, 62, 72 are each divided into N/2 signals of equal amplitude and phase to be supplied to the corresponding RF switches 44, 46, 48 of the respective N/2 aperture partitioning selectors 40.

Magic T coupler devices 57, 67 and 77 are well known in the art and are described, for example, in "Microwave Antenna Theory and Design," edited by Samuel Silver, 1965, 1949, Dover Publications, at page 572. In the receiver mode, the sum of the two partial sum signals at ports 53X and 53Y, i.e., the sum of the signals $A_i$, $i=1$ to N, will appear at the sum port 57X of the Magic T coupler 57 with the power at the difference port 56Y being essentially zero. The respective sum ports 57X, 67X and 77X of the Magic T couplers 57, 67 and 77 are then coupled to the receiver 92 for signal processing. Each output at the respective ports 57X, 67X and 77X represents the corresponding array subaperture output resulting from an arbitrary partition of the array formed by the positions of the corresponding RF switches 44, 46 and 48.

The difference ports 57Y, 67Y and 77Y of the Magic T couplers 57, 67 and 77 are connected to respective A, B and C excitation signal sources, in this case represented by excitation frequency synthesizer 90.

In the transmit mode, the excitation signal applied at the difference port 57Y is divided into two signals, of equal amplitude and phase, at the sidearm ports 56X and 56Y, which are in turn divided by the manifold network 52 into N selector port excitation signals, of equal amplitude and phase, to be supplied to the corresponding RF switches 44 of the respective aperture partitioning selectors 40. Similar functions are provided by the manifold networks 62 and 72. The RF switches 44 select the appropriate module for the excitation. For example, an excitation signal "A" applied at port 57Y will be divided into N equal power, equal phase signals to be supplied to the RF switches 44 of the N aperture partitioning selectors 40. For those modules to be employed in the transmit mode for the A excitation signal, switch 44 will be set to the "on" position. The A signal component may be combined with the B and C excitation signal components, if RF switches 46 and 48 are also switched to the "on" position.

The array system described with respect to FIG. 1 provides a means for arbitrary partitioning of the array aperture formed by the N radiative elements 15 comprising the system. The three RF switches 44, 46 and 48 comprising the aperture partitioning selector 40 provide arbitrary aperture partitioning on receive as well as on transmit. The position of each switch determines the size and configuration of each partition. On reception, the position of each switch does not affect the outputs of the other two switches; therefore, partitions can overlap during this mode of operation. Since the array feed is not divided into quadrants, full roll stabilization is realizable for any arbitrary partitioning, as will be described more fully below. On transmission, overlapping partitions are also possible if the power amplifier 24 of modules 20 is operated in the linear mode.

The provision of the beam steering phase shifters 43A–C and variable attenuators 45A–C in each channel of the partition selector provides the capability of independently steering or amplitude weighting the beam or pattern formed by each sub-aperture. If these phase shifters and variable attenuators are employed in the aperture partitioning selector 40, then the phase shifter 32 and variable attenuator 28 in the module 20 are unnecessary. The phase shifters 43A–C and attenuators 45A–C could, of course, be omitted from the selectors 40 if the flexibility provided by these elements is unnecessary; in this case the module phase shifter 32 and attenuator 28 may be employed to steer and shape the beam.

With the phase shifters 43A–C, three independent apertures may be formed with three independently steerable beams, which on transmit may be excited by three independent exciter signals generated by synthesizer 90. There is another advantageous function which may be implemented using the M exciter signals, to provide extended bandwidth capability for off-broadside beams for very large apertures. For such large apertures, the relatively large spacing between the radiative elements 15 on opposite sides of the aperture can serve to destroy the additive effects on signals from the spaced elements on an off-broadside target for very short duration impulse transmissions, i.e., having a wide bandwidth, so that the array beams are effectively limited to the broadside direction. To correct for the differences in range from the spaced aperture elements to the target, the aperture may be partitioned into M contiguous non-overlapping subapertures, each driven by a delayed version of the same excitation signal. Depending on the beam position, the respective exciter signals are respectively delayed by some predetermined time period needed to correct for the range difference between the target and the radiative elements 15 in the respective sub-apertures. Thus, if the aperture is divided into subapertures A, B, C, with aperture C closest to the target located in the off-broadside beam, then the exciter signal driving aperture A, the subaperture furthest from the target, will not be delayed at all, the exciter signal driving aperture B will be delayed by some period T, and the exciter signal driving aperture C will be delayed by some period 2T, and T being a function of the beam angle and the aperture size. In a similar manner, the large-sized aperture may be divided into three contiguous sub-apertures on receive, as on transmit, and the summed components at ports 57X, 67X and 77X, respectively, may be delayed by receiver 92 by appropriate respective delays to correct for the range difference between the respective subaperture radiative elements and the off-broadside target.

Several specific examples of exemplary aperture partitioning readily achievable by the system described with respect to FIG. 1 are now described.

SIMULTANEOUS SUM, AZIMUTH DIFFERENCE AND ELEVATION DIFFERENCE PATTERNS

As is well known in the art, many radar systems employ two or more displaced radiating/receive elements (or groups of elements) so that each receives the signal from a point source at a slightly different phase. The received signals from each receive element (or group) are summed to form the array sum signal, and the received signal from one element (or group) is subtracted from the signal received on the other element (or group) to form a difference signal. The difference signal is a measure of the relative location of the target from the array boresight, since the difference signal will be nulled if the boresight is perfectly aligned on the target.

Difference signals are typically provided with respect to the azimuth and elevation null planes. Thus, the azimuth difference signal indicates the angular offset of the boresight from the target with respect to the azimuth null plane, with the sign of the signal indicating the direction of the offset. Similarly, the magnitude and sign of the elevation difference signal indicates the angular offset of the boresight from the target with respect to the orthogonal elevation null plane.

Figure 2:
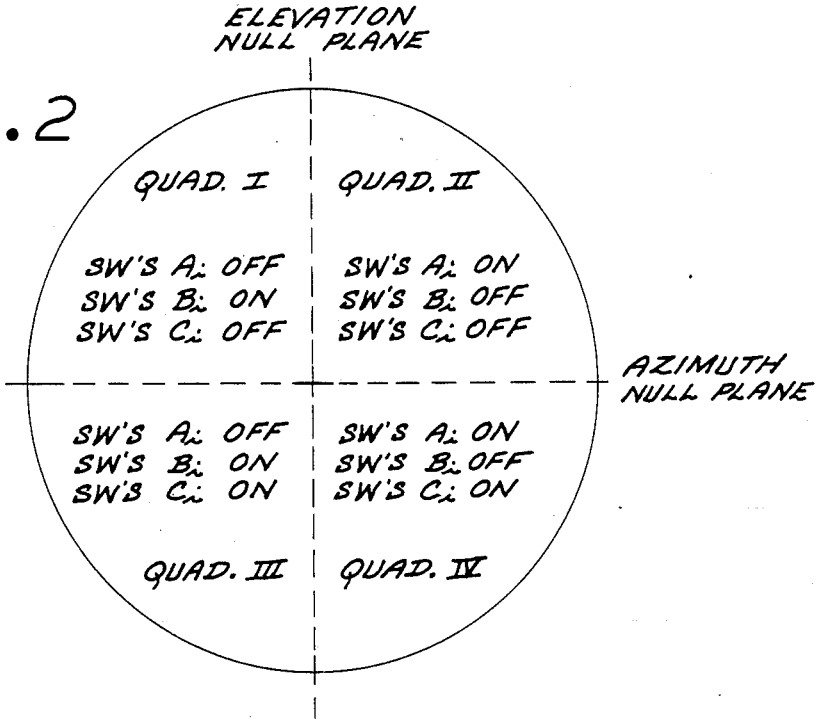
FIG. 2 is a functional diagram illustrative of an array system as in FIG. 1 with a circular aperture, showing the division of the aperture into four quadrants for generating simultaneous sum, azimuth difference, and elevation difference patterns.

The array system described with respect to FIG. 1 with the index M=3 can be employed to divide the array system radiative array aperture into three or less sub-apertures. FIG. 2 is a functional diagram for dividing an exemplary circular aperture, i.e., where the N radiative elements 15 are distributed throughout the area circumscribed by a circle, into four quadrants for generating simultaneous sum, azimuth difference and azimuth elevation signals. In this example, the radiative elements of the array system are arranged in four quadrants I to IV, defined by the azimuth null plane and the elevation null plane.

To form the azimuth difference signal, the combined contributions from the signals received by the radiating elements quadrants II and IV are subtracted from the combined signals received by the radiating elements in quadrants I and III. The elevation difference signal is provided by subtracting the combined signals received at the radiating elements in quadrants III and IV from the combined signals received at the elements in quadrants I and II. To configure the system to provide simultaneous sum, difference azimuth and difference elevation patterns, the respective positions of the A, B and C RF switches 44, 46 and 48 of the modules associated with radiative elements in the respective quadrants are shown in FIG. 2. Thus, for those partition selectors 40 connected to modules 20 connected to radiative elements 15 in quadrant I, the A and C switches are positioned to the "off" position, and the B switches are positioned to the "on" position. For the partition selectors 40 coupled to modules 20 and radiative elements 15 in quadrant II, the A switches are positioned to the "on" position, and the B and C switches are positioned to the "off" position. For those partition selectors 40 associated with modules 20 and radiative elements 15 in quadrant III, the A switches are positioned to the "off" position, and the switches B and C are positioned to the "on" position. For those partition selectors 40 associated with modules 20 and radiative elements 15 in quadrant IV the A and C switches are positioned to the "on" position, and the B switches are positioned to the "off" position. The three manifold apparatus outputs on reception are $$\Sigma_A = (Quad\ II) + (Quad\ IV)$$

$$\Sigma_B = (Quad\ I) + (Quad\ III)$$

$$\Sigma_C = (Quad\ III) + (Quad\ IV)$$

from which $$\begin{aligned}
\Sigma &= (\text{Quad I}) + (\text{Quad II}) + (\text{Quad III}) + (\text{Quad IV}) \\
&= \Sigma_A + \Sigma_B \\
\Delta AZ &= [(\text{Quad I}) + (\text{Quad III})] - [(\text{Quad II}) + (\text{Quad IV})] \\
&= \Sigma_B - \Sigma_A \\
\Delta EL &= [(\text{Quad I}) + (\text{Quad II})] - [(\text{Quad III}) + (\text{Quad IV})] \\
&= \Sigma - 2\,[(\text{Quad III}) + (\text{Quad IV})] \\
&= \Sigma - 2\,\Sigma_c \\
&= \Sigma_A + \Sigma_B - 2\,\Sigma_c
\end{aligned}$$

The invention provides a means of arbitrarily assigning a particular radiating element to a particular quadrant of the array without requiring changes in hard wired connections or complex signal processing. The array controller is provided with attitude position data, e.g., from the aircraft inertial platform 98 in the case of an aircraft-mounted active array. This data may be used to direct the aperture partitioning selectors 40 to adjust the respective module RF switches to the correct state for the particular array roll angle.

Figure 3:
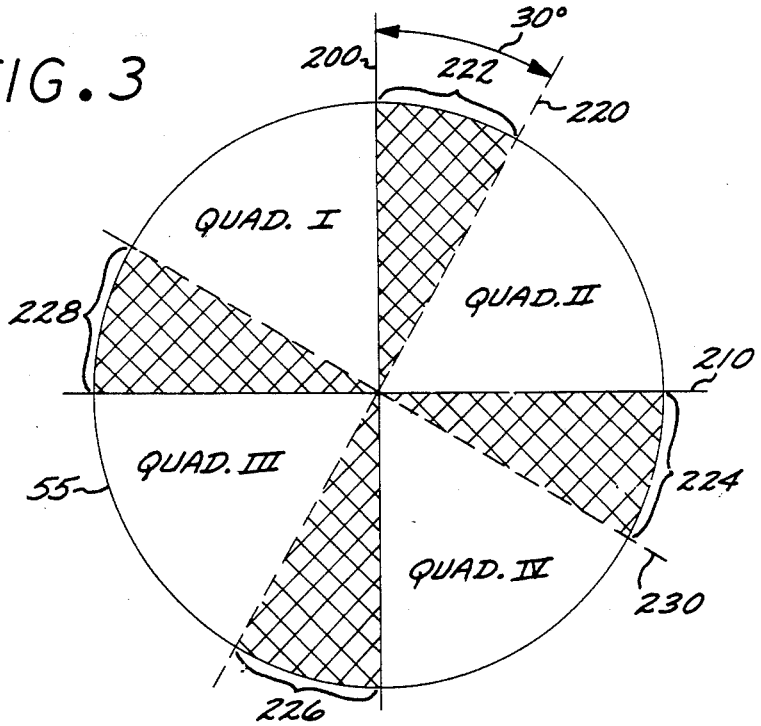
FIG. 3 is a diagrammatic depiction of roll stabilized array quadrants for providing azimuth and elevation difference patterns.

This may be appreciated with reference to FIG. 3. Assume that the array reference plane is initially aligned with azimuth plane 210. The switch positions of the aperture partitioning selectors 40 are as shown in FIG. 2. Now assume that the array rolls to a 30 degree angle with respect to the azimuth plane, such that the array reference planes are aligned with phantom lines 220 and 230 shown in FIG. 3. To roll stabilize the array with the horizon, the quadrant positions of certain of the radiative elements 15 are reassigned. Thus, the radiative elements 15 located in the cross-hatched sector 222, nominally in quadrant II for the case when the aircraft is aligned with the horizon, are reassigned to quadrant I, i.e., the roll stabilized or "new" quadrant I is the former or "old" quadrant I minus the elements 15 in cross-hatched sector 228 plus the elements in cross-hatched sector 222. Similarly, the radiative elements in sector 224, nominally in quadrant IV, are reassigned to quadrant II. The radiative elements in sector 226, formerly in quadrant III, are reassigned to quadrant IV. The radiative elements in sector 228, formerly in quadrant I, are reassigned to quadrant I.

To implement the reassignment of radiative elements requires only that the positions of the RF switches of the aperture partitioning selectors 40 associated with the radiative elements 15 whose respective quadrant positions are realigned be adjusted to conform to the states described in FIG. 3 for the respective new quadrants. The array controller 94 may effect this adjustment rapidly, so that the azimuth and elevation difference patterns may be electronically roll stabilized, without the need for mechanical roll gimbals or complex signal processing.

The system of FIG. 1 provides a means for roll stabilizing the aperture partitioning of the array with respect to rotation of the array relative to a predetermined reference plane, such as plane 210 in FIG. 3. The array may be assumed to have an array reference plane, such as plane 230 in FIG. 3. The radiative-element-to-sub-aperture connections for the initial or first roll position state may be stored in memory by the array controller. To compensate for rotation of the array to a particular roll angle relative to the initial position state, the array reference plane 230 is assumed to have rotated by the particular roll angle relative to the reference plane 210, and the positions of the radiative elements (and associated module 20 and aperture partitioning selector 40) relative to the reference plane associated with the initial pre-roll state are mapped into the same corresponding positions relative to the new position of the array reference plane.

ADAPTIVE NULLING

Figure 4:
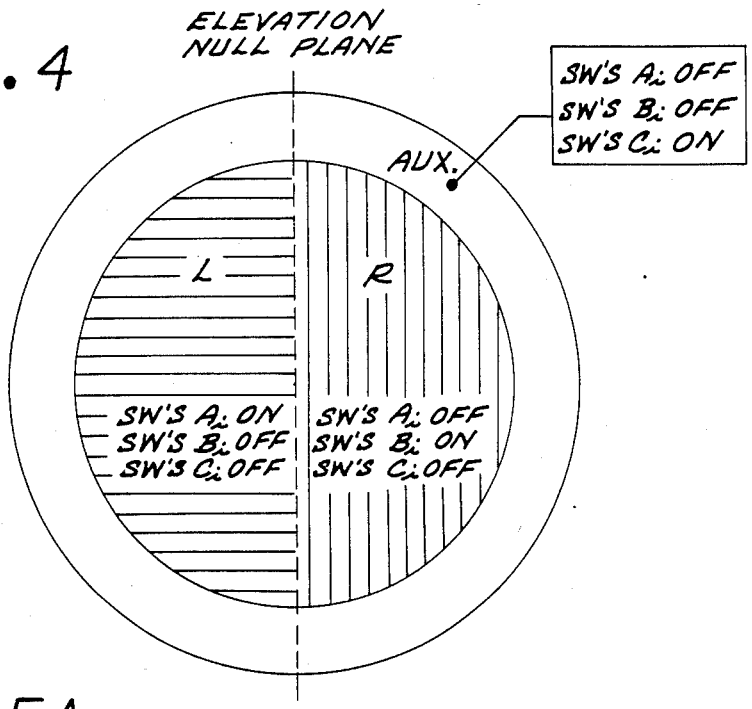
FIG. 4 is a functional diagram illustrative of an array system as in FIG. 1 with a circular aperture, showing the generation of an auxiliary aperture for adaptive nulling and simultaneous sum and azimuth difference patterns.

FIG. 4 shows a functional description of the positions of the RF switches of the aperture partitioning selectors 40 to generate an auxiliary aperture for adaptive nulling and simultaneous sum ($\Sigma$) and azimuth difference ($\Delta$AZ) with a circular aperture. Alternatively, the elevation difference pattern could be generated instead of the azimuth difference pattern. Other combinations are possible, e.g., a communication aperture with two auxiliary apertures. The three manifold apparatus outputs resulting from the configuration shown in FIG. 4 are $$L = \Sigma_A$$

$$R = \Sigma_B$$

$$AUX = \Sigma_C$$

from which $$\Sigma = \Sigma_A + \Sigma_B$$

$$\Delta AZ = \Sigma_A - \Sigma_B$$

$$\text{Auxiliary} = \Sigma_C$$

OVERLAPPING PARTITIONS

Figure 5A:
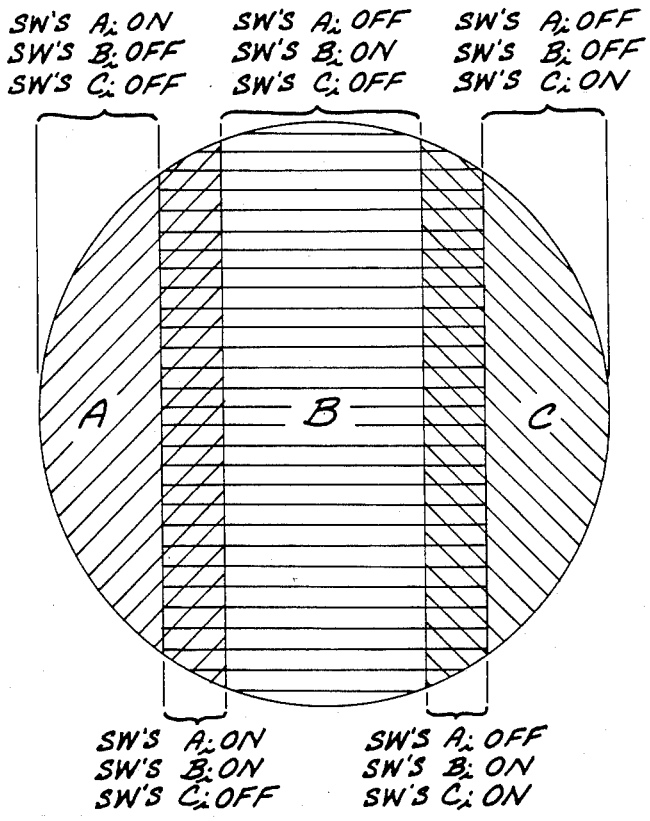

FIGS. 5A and 5B describe the positioning of the RF switches of the aperture partitioning selectors 40 to obtain two possible aperture partitions with overlap. As illustrated by the two exemplary partitions in FIGS. 5A and 5B, the three regions A, B, and C can take any arbitrary configuration. As will be appreciated by those skilled in the art, the overlapping apertures shown in FIG. 5A may be necessary in some radar applications for detection and location of slowly moving targets.

In the case illustrated in FIG. 5B, aperture A comprises the entire area of the circular aperture of radius $r_A$, aperture B comprises the area within the intermediate circle of radius $r_B$, and aperture C comprises the area within the inner circle of radius $r_C$. The apertures are independent, and their beam may be scanned and shaped (by the respective pairs of phase shifters and attenuators comprising partitioning selector 40) independently of each other. The three aperture outputs are $$A = \Sigma_A$$

$$B = \Sigma_B$$

$$C = \Sigma_C$$

One advantage of the embodiment shown in FIG. 1 is that the aperture partition selector 40 may be located outside the corresponding module 20, allowing the array system to be implemented with N universal modules. The additional elements needed to provide the increase in aperture complexity are located outside the module. Since not all applications require the additional complexity, the same modules 20 may be used for all applications. For example, an active array antenna with roll stabilization for a two-way monopulse radar requires at least two apertures (M=2 or greater); on the other hand, a half-duplex communication system needs only a single aperture (M=1).

Higher order partitioning can be obtained by increasing the number of outputs from the aperture partitioning selector 40, i.e., increasing M. If a particular partition is always limited to a certain physical area of the aperture, then the corresponding manifold is required to sum only those signals from manifolds lying in the desired area. For example, if a guard aperture formed by four preselected radiative elements is required, then only the corresponding four module outputs need to be summed; this will require only a four input manifold.

While the invention has been described with respect to a circular array aperture, it may readily be practiced with arrays having other configurations, e.g., rectangular or trapezoidal.

A multifunction active array system has been described which is capable of providing a number of useful features. For example, the array system aperture can be partitioned into M or fewer subapertures, which can overlap. The aperture partitioning on transmit and on receive can differ in any arbitrary manner. Each subaperture can transmit and receive at different frequencies and/or scan angles. For M=3 the array system can be used to provide simultaneous sum, azimuth difference and elevation difference patterns to provide a subaperture for adaptive nulling, with simultaneous sum and azimuth (or elevation) difference patterns or a simultaneous sum pattern with a guard aperture. With the capability for multiple independent transmit apertures, the system further provides off-broadside expanded bandwidth capabilities for large apertures. The system further provides the capability for electronic roll stabilization for all modes of operation.

The invention is not limited to active array systems, but may also be employed with passive array systems which do not employ active modules. In the case of a passive array system, the modules 20 shown in FIG. 1 are eliminated, and the aperture partitioning selectors 40 are connected directly to the respective radiative elements 15. Alternatively, the modules 20 could consist of only the attenuator 28 and phase shifter 32. Arbitrary aperture partitioning is available in this case as well.

It is understood that the above-described embodiment is merely illustrative of the possible specific embodiments which may represent principles of the present invention. Other arrangements may be devised in accordance with these principles by those skilled in the art without departing from the scope of the invention.

What is claimed is:

1. An array system for providing a plurality of array subapertures, comprising:

an array of N spaced radiative elements forming a radiative aperture;

N aperture partitioning selector devices respectively coupled one to a respective radiative element for dividing said radiative aperture into M or fewer subapertures, comprising:

an M-way power divider device having M device ports and a radiative element port coupled to said radiative element, said divider device adapted to divide the power of signals received at said radiative element into M component signals of substantially equal power at said device ports; and means for selectively connecting said respective device ports of said power divider device to a corresponding partition port of said selector device;

M manifold apparatus having N manifold ports, each of said ports respectively connected to a corresponding partition port of said N aperture partitioning selectors, said manifold apparatus comprising means for combining the respective component signals at said corresponding partition ports of said N selector devices and providing a respective subaperture signal at an output port of each of said M manifold apparatus;

an array system controller coupled to said selector devices for controlling said means for selectively connecting said device ports to control the partitioning of said aperture into M or fewer subapertures, each subaperture comprising the radiative elements selectively connected to said respective manifold apparatus; and a receiver responsive to said M subaperture signals to provide a selected partitioned aperture function.

2. The array system of claim 1 wherein said respective manifold apparatus comprises a uniform corporate network.

3. The array system of claim 1 wherein said means for selectively connecting said respective device ports to a corresponding partition port of said selector comprises M RF switches respectively selectively coupling a respective device port to a corresponding partition port.

4. The array system of claim 1 wherein said means for selectively connecting said respective device ports of said power divider device to a corresponding selector port further comprises means for programmably phase shifting the respective electrical signals coupled between said respective device ports and said corresponding selector port, said phase shifting means being controlled by said system controller to steer the corresponding sub-aperture array beam to a desired direction.

5. The array system of claim 1 wherein said means for selectively connecting said respective device ports of said power divider device to a corresponding selector port further comprises means for programmably attenuating the respective electrical signals coupled between said respective device ports and said corresponding selector port, said attenuating means being controlled by said system controller to achieve a desired amplitude weighting of the sub-aperture radiative elements.

6. The array system of claim 1 wherein further comprising means for roll stabilizing the respective array sub-apertures, comprising:

means for providing a roll signal indicative of the rotational position of an array reference plane of said array relative to a predetermined reference plane; and wherein said array controller further comprises means responsive to said roll signal to control the means for selectively connecting said respective device ports to a corresponding partition port so as to adjust the connection of the radiative elements to particular sub-apertures to correct for the rolling of said aperture relative to said reference plane.

7. An active array system for providing a plurality of array subapertures, comprising:

an array of N spaced radiative elements forming a radiative aperture;

N active modules respectively coupled one to each radiative element, said modules comprising a receive channel comprising a low noise amplifier coupled to said corresponding radiative element for amplifying signals received at said corresponding radiative elements and providing said amplified receive signals at a module selector port;

N aperture partitioning selector devices respectively coupled one to a selector port of each module for dividing said radiative aperture into M or fewer subapertures, comprising:

an M-way power divider device having M device ports and a module port coupled to said selector port of said module, said divider device adapted to divide the power of said amplified receive signals at said module port into M component signals of substantially equal power at said device ports; and means for selectively connecting said respective device ports of said power divider device to a corresponding partition port of said selector;

M manifold apparatus having N manifold ports, each of said ports respectively connected to a corresponding partition port of said N aperture partitioning selectors, said manifold apparatus comprising means for combining the respective component signals at said corresponding partition ports of said N aperture partitioning selectors and providing a respective subaperture signal at an output port of each of said M manifold apparatus;

an array system controller coupled to said aperture partition selectors for controlling said means for selectively connecting said device ports to control the partitioning of said aperture into M or fewer subapertures, each subaperture comprising the radiative elements and associated modules connected to said respective manifold apparatus; and a receiver responsive to said M subaperture signals to provide a selected partitioned aperture function.

8. The array system of claim 7 wherein said respective manifold apparatus comprises a uniform corporate network.

9. The array system of claim 7 wherein said means for selectively connecting said respective device ports to a corresponding partition port of said selector comprises M RF switches respectively selectively coupling a respective device port to a corresponding partition port.

10. The array system of claim 7 wherein said means for selectively connecting said respective device ports of said power divider device to a corresponding selector port further comprises means for programmably phase shifting the respective electrical signals coupled between said respective device ports and said corresponding selector port, said phase shifting means being controlled by said system controller to steer the corresponding sub-aperture array beam to a desired direction.

11. The array system of claim 7 wherein said means for selectively connecting said respective device ports of said power divider device to a corresponding selector port further comprises means for programmably attenuating the respective electrical signals coupled between said respective device ports and said corresponding selector port, said attenuating means being controlled by said system controller to achieve a desired weighting of the subaperture radiative elements to reduce the beam sidelobe level.

12. The array system of claim 7 wherein further comprising means for roll stabilizing the respective array sub-apertures, comprising:

means for providing a roll signal indicative of the rotational position of an array reference plane of said array relative to a predetermined reference plane; and wherein said array controller further comprises means responsive to said roll signal to control the means for selectively connecting said respective device ports to a corresponding partition port so as to adjust the connection of the radiative elements to particular sub-apertures to correct for the rolling of said aperture relative to said reference plane.

13. A multifunction active array system for providing a plurality of arbitrary array subapertures, comprising:

an array of N spaced radiative elements forming a radiative aperture;

N active modules respectively coupled one to each radiative element, said module comprising a transmit channel comprising a transmit amplifier for amplifying excitation signals and a receive channel comprising a low noise amplifier for amplifying signals received at said corresponding radiative element, and means for coupling either said transmit channel or said receive channel to said radiative element;

an excitation signal source for generating one or more excitation signals;

a plurality of aperture partitioning selectors coupled one to a selector port of each module for dividing said radiative aperture into M or fewer subapertures, each selector comprising:

an M-way power divider/combiner device having M device ports and a module port coupled to said selector port of said corresponding module; and means for selectively connecting said respective device ports of said power divider/combiner device to a corresponding partition port of said selector;

M manifold apparatus having N manifold ports, each of said ports respectively connected to a corresponding partition port of said N aperture partitioning selectors, said manifold apparatus arranged to combine signals at said partition ports of the N modules and provide a combined subaperture signal at a combiner output of said manifold apparatus in a receive mode, said manifold apparatus being further arranged to divide an excitation input signal into N excitation module signals at said N ports of said manifold apparatus in a transmit mode; and an array system controller coupled to said aperture partition selector and said modules for controlling said means for selectively connecting said device ports to control the partitioning of said aperture into M or fewer subapertures and to select either the receive channel or the transmit channel of said module.

14. The array system of claim 13 wherein said means for coupling either said transmit channel or said receive channel comprises a first RF switch for selectively connecting either the output of said transmit amplifier or the input of said low noise amplifier to said radiative element.

15. The array system of claim 14 wherein said means for coupling either said transmit channel or said receive channel of said respective modules further comprises a second RF switch for selectively coupling said module selector port to either the input of said transmit amplifier or the output of said low noise amplifier.

16. The array system of claim 15 wherein said modules each further comprise a beam steering phase shifter coupled between said second RF switch, said phase shifter controlled by said array controller for steering an array beam formed by said array in a desired direction.

17. The array system of claim 16 wherein said modules each further comprise a variable RF attenuator coupled between said second RF switch and said selector port of said module, said variable attenuator controlled by said array controller for weighting the contributions to the array beam from the corresponding radiative element.

18. The array system of claim 13 wherein said means for selectively connecting said respective device ports to a corresponding partition port of said selector comprises M RF switches respectively selectively coupling a respective device port to a corresponding partition port.

19. The array system of claim 13 wherein said means for selectively connecting said respective device ports of said power divider/combiner device to a corresponding selector port further comprises means for programmably phase shifting the respective electrical signals between said respective device ports and said corresponding selector port, said phase shifting means being controlled by said system controller to steer the corresponding sub-aperture beam to a desired direction.

20. The array system of claim 13 wherein said means for selectively connecting said respective device ports of said power divider/combiner device to a corresponding selector port further comprises means for programmably attenuating the respective electrical signals coupled between said respective device ports and said corresponding selector port, said attenuating means controlled by said system controller to achieve a desired weighting of the sub-aperture radiative elements to reduce the beam sidelobe level.

* * * * *